US011802549B2

(12) United States Patent
Mayer et al.

(10) Patent No.: US 11,802,549 B2
(45) Date of Patent: Oct. 31, 2023

(54) ELECTRICALLY CONDUCTIVE LIQUID PROPELLANT PULSED PLASMA THRUSTER

(71) Applicant: Nederlandse Organisatie voor toegepast-natuurwetenschappelijk onderzoek TNO, 's-Gravenhage (NL)

(72) Inventors: Alfons Ernst Hendrik Johan Mayer, Den Hoorn (NL); Wolter Pieter Wilhelmus Wieling, Den Hoorn (NL); Robertus Johannes Gerhardus Hermsen, Nootdorp (NL)

(73) Assignee: Nederlandse Organisatie voor toegepast-natuurwetenschappelijk onderzoek TNO, 's-Gravenhage (NL)

( * ) Notice: Subject to any disclaimer, the term of this patent is extended or adjusted under 35 U.S.C. 154(b) by 71 days.

(21) Appl. No.: 17/639,741

(22) PCT Filed: Sep. 4, 2020

(86) PCT No.: PCT/NL2020/050548
§ 371 (c)(1),
(2) Date: Mar. 2, 2022

(87) PCT Pub. No.: WO2021/045623
PCT Pub. Date: Mar. 11, 2021

(65) Prior Publication Data

US 2022/0333582 A1 Oct. 20, 2022

(30) Foreign Application Priority Data

Sep. 6, 2019 (EP) ..... 19196003

(51) Int. Cl.
*F03H 1/00* (2006.01)

(52) U.S. Cl.
CPC ..... *F03H 1/0012* (2013.01); *F03H 1/00* (2013.01); *F03H 1/0006* (2013.01)

(58) Field of Classification Search
CPC ..... F03H 1/00; F03H 1/0012; F03H 1/0006
See application file for complete search history.

(56) References Cited

U.S. PATENT DOCUMENTS 3,754,397 A 8/1973 Kidd et al.
6,295,804 B1 * 10/2001 Burton ..... F03H 1/00 60/202

(Continued)

OTHER PUBLICATIONS

European Patent Office, International Search Report in corresponding International Application No. PCT/NL2020/050548, dated Nov. 10, 2020 (3 pages).

(Continued)

*Primary Examiner* — Steven M Sutherland
(74) *Attorney, Agent, or Firm* — Leydig, Voit & Mayer, Ltd.

(57) ABSTRACT

In an aspect of the invention there is provided a plasma thruster device comprising: an electrically insulating substrate, said substrate comprising one or more feed channels for feeding an electrically conductive liquid to a bridge structure; said substrate further provided with electrical terminals; said bridge structure configured to form, when provided with the electrically conductive liquid, an electrical conducting bridge; said bridge structure configured to form contact areas in electrical contact with said electrical terminals, said bridge structure thereby connecting the contact areas, said bridge structure arranged for forming a plasma of said electrically conductive liquid, when the electrically conductive liquid is ionized by a current peak flow circuit that contacts the contact areas via said electrical terminals.

15 Claims, 8 Drawing Sheets

10

(56) References Cited

U.S. PATENT DOCUMENTS

| | | | | |
|---|---|---|---|---|
| 7,518,085 | B1 * | 4/2009 | Krishnan | H05H 1/54 219/121.48 |
| 2008/0163605 | A1 | 7/2008 | Land et al. | |
| 2010/0018184 | A1 | 1/2010 | Gilchrist et al. | |
| 2018/0223815 | A1 * | 8/2018 | Anderson | F03H 1/0012 |
| 2020/0407084 | A1 * | 12/2020 | Shashurin | B64G 1/405 |

OTHER PUBLICATIONS

T.E. Markusic et al., "Design of a High-Energy, Two-Stage Pulsed Plasma Thruster," 38$^{th}$ AIAA Joint Propulsion Conference, Jul. 10, 2002, Indianapolis, Indiana, USA, XP055674454 (20 pages)

* cited by examiner

A

B

B

A

ELECTRICALLY CONDUCTIVE LIQUID PROPELLANT PULSED PLASMA THRUSTER

CROSS-REFERENCE TO RELATED APPLICATIONS

This patent application is a U.S. National Phase of PCT International Application No. PCT/NL2020/050548, filed Sep. 4, 2020, which claims priority to European Application No. 19196003.8, filed Sep. 6, 2019, which are both expressly incorporated by reference in their entireties, including any references contained therein.

FIELD

The present invention relates to a plasma thruster device.

BACKGROUND

Classical pulsed plasma thrusters are known as a propulsion technology e.g. for use in satellites. Although the thrust to power ratio of a pulse plasma thruster (PPT) is limited, their simplicity, reliability and often solid state (e.g. PTFE) propellant makes them attractive as a thruster for small satellites. These pulsed plasma thrusters can operate at high frequencies so an almost continuous operation of the thruster may be obtained. Such known systems typically have two main electrical circuits. The first main electrical circuit is an ignition circuit, which may for example have a capacitive circuit for storing electrical power, and a switching circuit, for releasing the electrical power and generating an electrical arc. This electrical arc ablates and ionizes a small fraction of the propellant into a low energy plasma. The second main electrical circuit generates an electrical discharge through the formed low energy plasma, thereby generating a Lorentz force due to the interaction of a magnetic field and the electric discharge current through the plasma. This Lorentz force accelerates the plasma out of the thruster. An advantage of the PPT is its simplicity in design and operations. This means it is very robust and can effectively be made very small (which is advantageous for modern miniaturized spacecraft). A disadvantage is that the thruster efficiency of a classical PPT is quite low, resulting in a relatively low thrust to power ratio. Furthermore the anode and cathode plates of the accelerator stage, as well as the anode and cathode of the igniter (e.g. spark plug) of the igniter discharge stage, suffer from erosion.

A background of an advanced pulsed plasma thruster concept is given in T. E. Markusic, Y. C. F. Thio, and J. T Cassibry, "Design of a High-Energy, Two-Stage Pulsed Plasma Thruster," presented at 38th AIAA Joint Propulsion Conference, Indianapolis, Ind., Jul. 7-10, 2002. In the proposed structure liquefied lithium is pumped between electrodes arranged at one end of an acceleration channel, where a lithium droplet grows in size until the distance between the electrodes is completely bridged—thereby closing an electrical circuit resulting in a discharge of a high power capacitor—thereby ionizing the lithium droplet. The resulting plasma is accelerated and is jetted out of the acceleration channel. The lithium has a low density (0.53 g/cm3) and is liquefied by heating it above its melting point of 454 K. Because of the size of the droplet the generated plasma has a low velocity and low thrust power. A second electric acceleration stage is used wherein an electric circuit deposits most energy in the plasma for the accelerator stage, to increase the plasma velocity for generating thrust. This multi stage process typically lasts several microseconds to deliver a complete cycle that can be repeated. Also, in the known thruster, the electrodes for ionizing the propellant are eroded after continued use, so that lifetime is limited and structure, materials and geometry of the known plasma thrusters are quite constrained in their operational use. The development of a small and reliable thruster device is therefore desirable but needs an improvement of the system before it can be miniaturized.

SUMMARY

In one aspect of the invention there is provided the features listed in claims 1. In particular, a plasma thruster device comprises: an electrically insulating substrate, said substrate comprising one or more feed channels for feeding an electrically conductive liquid to a bridge structure; said substrate further provided with electrical terminals;

said bridge structure configured to form, when provided with the electrically conductive liquid, an electrical conducting bridge;

said bridge structure configured to form contact areas in electrical contact with said electrical terminals, said bridge structure thereby connecting the contact areas, said bridge structure arranged for forming a plasma of said electrically conductive liquid, when the electrically conductive liquid is ionized by a current peak flow circuit that contacts the contact areas via said electrical terminals. By using a liquid as a source material for ionization the conductive path can be renewed after a current pulse. The electrical connection to the part that will be turned into plasma can be made through the lines through which the liquid is fed. This avoids any erosion to the electrodes, as the electrical contacts in direct contact with the plasma are a liquid and these will be replenished after each electrical discharge. This feature provides renewable electrodes and bridge between those electrodes to which a high voltage of several kV can be applied. The application of this voltage causes a high, sharp-peaked current of several kA through the bridge structure that rapidly heats, melts, evaporates, and turns into plasma. The plasma expands at several km/s, without the need for a dedicated accelerator stage. This single stage electrically conductive liquid propellant pulsed plasma thruster has an excellent thruster to power ratio, and can be used regeneratively in a way that will prevent wear out or malfunction due to the ionisation of its propellant. It may have a high volumetric density, so that it can be miniaturized and used e.g. in nano satellites and in some embodiments may generate a high velocity (several km/s) plasma without the need of a Lorenz force accelerator.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
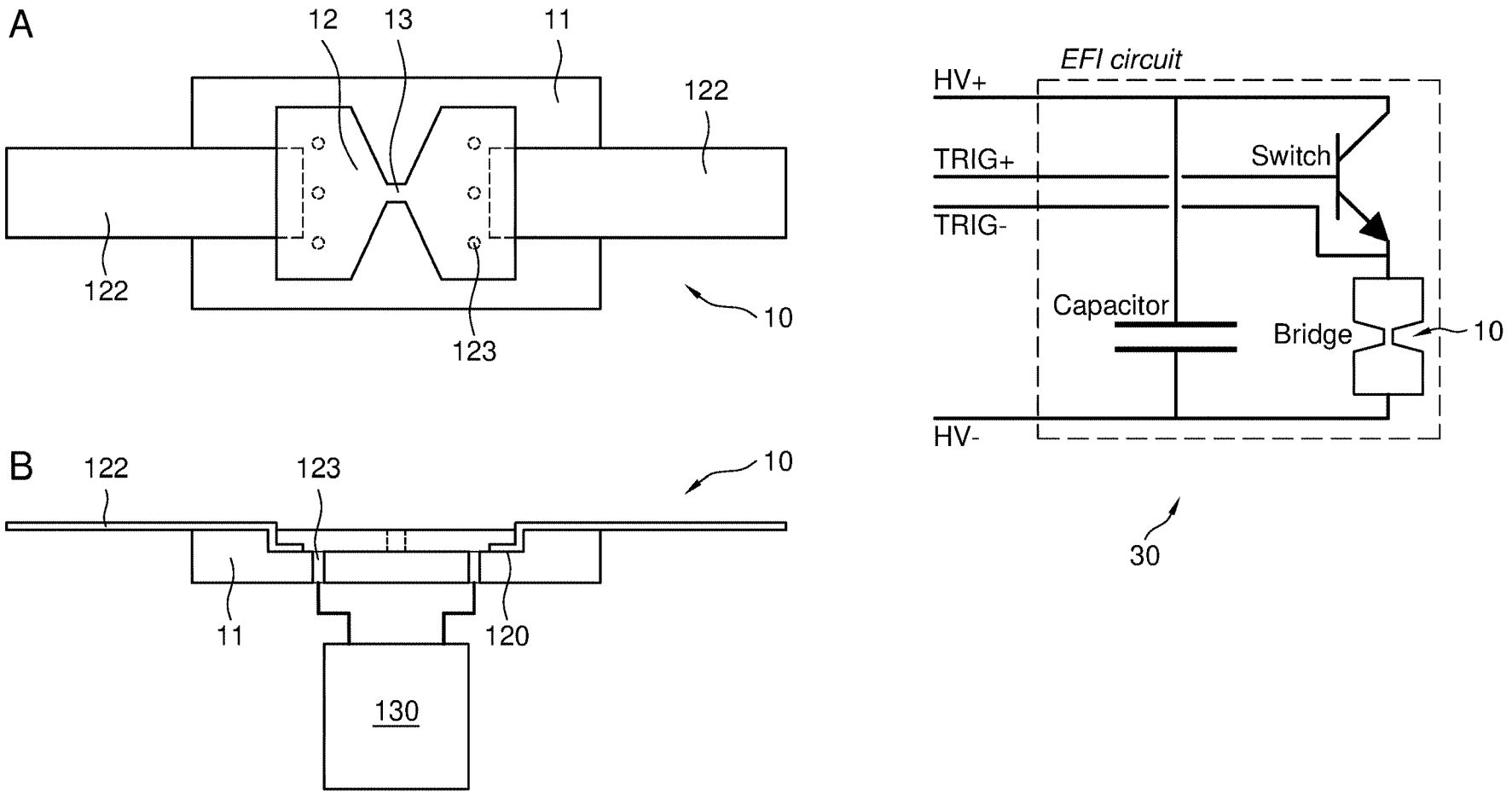
FIG. 1 (A+B) shows an embodiment of the electrically conductive liquid propellant pulsed plasma thruster device.

Unless otherwise defined, all terms (including technical and scientific terms) used herein have the same meaning as commonly understood by one of ordinary skill in the art to which this disclosure belongs as read in the context of the description and drawings. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some instances, detailed descriptions of well-known devices and methods may be omitted so as not to obscure the description of the present systems and methods. Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be further understood that the terms "comprises" and/or "comprising" specify the presence of stated features but do not preclude the presence or addition of one or more other features. All publications, patent applications, patents, and other references mentioned herein are incorporated by reference in their entirety. In case of conflict, the present specification, including definitions, will control.

The "substrate" may be a ceramic substrate or any other suitable non-conductive substrate, such as silicon or silicon like substrate (e.g. pyrex). This substrate may be part of the satellite that is facing the bridge. This substrate is non-conductive, non-reactive with the conductive liquid, hard, tough, strong, and erosion resistant. A "current peak flow circuit" may be a conventional circuit suitable for activating the plasma thruster device; i.e. by ionization, i.e. plasmafication of the bridge structure. Examples are presented in FIGS. 1 and 3.

The invention pertains, in some embodiments, to the field of nano satellites, in particular CubeSats. Satellites typically have plasma thrusters in order to maintain or alter course while orbiting earth. Space propulsion systems operate on the principle of accelerating a working mass (the propellant) to a high velocity, thereby producing thrust and changing the velocity of the spacecraft. The maneuverability of a satellite is usually expressed in terms of the velocity increase (or $\Delta V$) of the satellite that can be imparted by its propulsion system. Each type of manoeuvre requires a certain $\Delta V$. If a satellite must perform a series of specific manoeuvres, its propulsion system must be capable of producing a certain total $\Delta V$, which is the sum of the $\Delta V$ of each individual manoeuvre. The total $\Delta V$ that can be delivered by a propulsion system depends on the amount of propellant on board and on the efficiency with which this propellant is used to generate thrust. The 'propellant efficiency' is usually expressed in terms of 'specific impulse' (Isp), which is the total impulse that the propulsion system can deliver per unit of propellant weight (gravimetric specific impulse) or by unit of propellant volume (volumetric specific impulse). Due to the small size of CubeSats, the available propellant storage volume is limited and consequently the thruster's total impulse (or the total Delta-V capability) is also limited. The invention lies in providing direct plasmafication of the propellant of a pulse plasma thruster, omitting the need for a separate igniter and accelerator—thereby enabling the use of a high density electrically conductive liquid as a propellant. The direct plasmafication, electrically conductive liquid propellant pulse plasma thruster is capable of providing nano satellites with improved thruster efficiency, while at the same time not taking up too large a volume of the satellite.

FIG. 1 shows a schematic top view (A) and side view (B) of an embodiment wherein a pulse plasma thruster device 10 has a current peak flow circuit 30 (C). The bridge 13 of the pulse plasma thruster device 10, when shorted via the bridge circuit 12, is ionized by current peak flow circuit 30 for forming a plasma. The current peak flow circuit 30 discharges a current into the bridge 13 to ionize it, whereby a plasma jet is propelled away from the substrate 11 by means of electro-thermal acceleration. The current peak flow circuit is preferably a single stage circuit. A single stage circuit does not distinguish a physical multistage process, e.g. of a type in a conventional pulsed plasma thruster, that differentiates between the plasmafication stage and the acceleration stage. In contrast, in a single stage plasmafication process, a current peak flow is provided to the electric terminals that immediately ionizes the bridge structure. Because the current pulse is very short and concentrated into the bridge the propellant efficiency is very high, therefore a second stage is no longer required for thrust generation. This reduces complexity and removes problems with erosion of the second stage electrodes. The intensity of the pulse ensures that a very high fraction of the bridge material is effectively turned into plasma, and the energy efficiency is increased. The current pulse is very short, typically in the order of less than 50 nanoseconds, more preferably less than 10 nanoseconds, and only a very small part of the energy is lost as heat. For example, current peak flow circuit 30 comprises a capacitor charged to a high voltage, a switch, and a transmission line to the thruster device 10. When the capacitor is discharged via the transmission line into the thruster device 10, a plasma is propelled away from the substrate up to a velocity over 3 km/s. The bridge material 12, i.e. an electrically conductive liquid, from which the high velocity plasma is formed at bridge 13 has a relatively low electrical resistance for which the total dynamics of the electrical current peak flow circuit 30 is optimized so that most of the energy of the capacitor will be put in the bridge 13 of the thruster device. For example and without limiting, in some applications a resistance around 2Ω appears to be a maximum value for the bridge resistance.

A bridge structure may be of a size as small as about 200×300×5 micrometer, but other dimensions are suitable depending on the application and the propellant used. With the value of the density and the volume of the electric conductive liquid at the bridge, the mass of the propellant can be calculated that is turned in to a plasma during each pulsing cycle. For forming a plasma, first the materials have to be heated up to the boiling point, evaporate and turn into plasma. Using the proper values for the specific heat, the enthalpy of vaporization etc. the amount of energy needed to vaporise the bridge may be calculated. Additional energy is needed to heat-up this vapour further to turn it into a high temperature plasma. The resistance of bridge 13 strongly depends on the form, thickness and length-width ratio and should be rather low, e.g. in the order of 0.1-5 Ohm.

FIG. 1*b* shows the bridge 13 provided on an electrically insulating circuit substrate 11. The substrate 11 is provided with a shallow basin formed by basin boundaries 120 and provided with electrical terminals 122. For example the basin provides for a conductive liquid layer thickness smaller than 100 micron. One or more feed channels 123 are provided for feeding an electrically conductive liquid 12 to said basin 120. The connections to the bridge structure preferably quickly widen and/or thicken in directions away from the central bridge structure, so that current density and resistivity drop sufficiently fast that these paths are not heated and turned into plasma as well. To this end, the bridge 13 is formed by basin 120 that shapes the electrically conductive liquid 12 into a suitable shape, in the example a butterfly shape, and electrically connects to electrical terminals 122 provided in or on the substrate 11. The basin 120 is thus configured to form, when provided with the electrically conductive liquid 12, an electrical, low resistance conducting bridge structure 13 provided on the insulating substrate 11.

Figure 3:
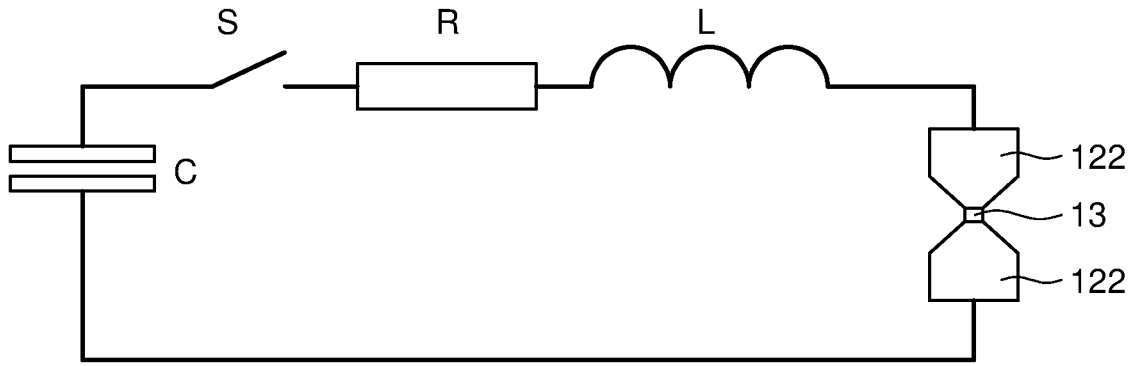
FIG. 3 (A+B) shows a schematic graph of the current peak flow circuit.
Figure 3:
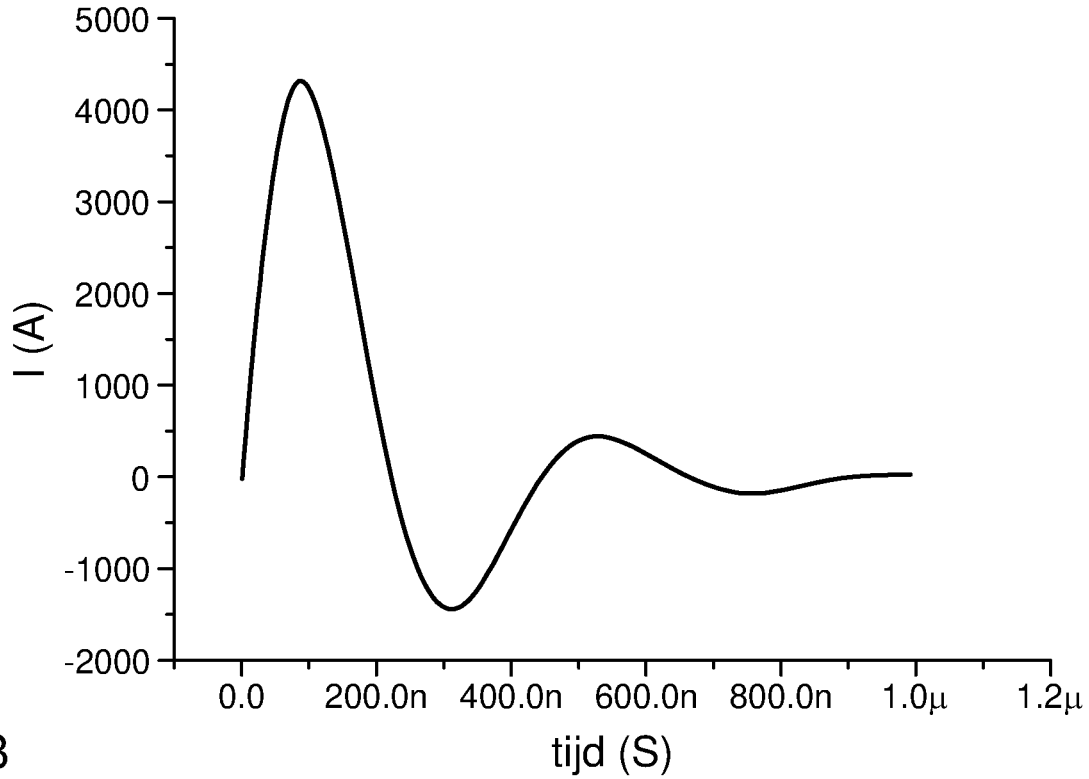

Bridge structure 13 provides an electrical connection (bridge) between anode and cathode, and is arranged for forming a plasma when the bridge structure 13 is ionized by a current peak flow circuit e.g. provided by current peak flow circuit 30 of FIG. 1 or an alternative circuit provided in for example but not limited to FIG. 3. In a preferred example, the electrical terminals 122 are provide by metal interconnection pads that underlie the electrical conductive liquid 12, in contact areas 132 of basin 120. Other suitable connection to the current peak flow circuit are feasible. Although the basin 120 is shown with a constant depth, the contact areas/side portions may have another depth compared to the bridge zone 13. Preferably the bridge structure and contact areas extend along the substrate, and a plasma jet can be formed substantially in a direction away from the substrate. For example the basin provides for a conductive liquid layer thickness smaller than 100 micron for the bridge. The basin may be provided with a wetting structure, e.g. a local roughening or material that improves the wetting behaviour of the liquid in order to form an optimal bridge structure of a layer thickness that is preferably lower than 10 micrometer. Schematically a connection feed is shown between a container 130 containing the electrically conductive liquid and the feeds 123 connecting to the basin 120. The anode side as well the cathode side of basin 120 have a propellant container who are electrically separated from one another. The container, feed channels and/or basin may comprise a heater for liquefying the electrically conductive liquid, e.g liquid metal. The feed container is arranged for containing the electrically conductive liquid, said feed container coupled to said one or more feed channels. It may comprise a liquid fill and drain mechanism for filling and draining the electrically conductive liquid to and from the feed container.

Figure 2:
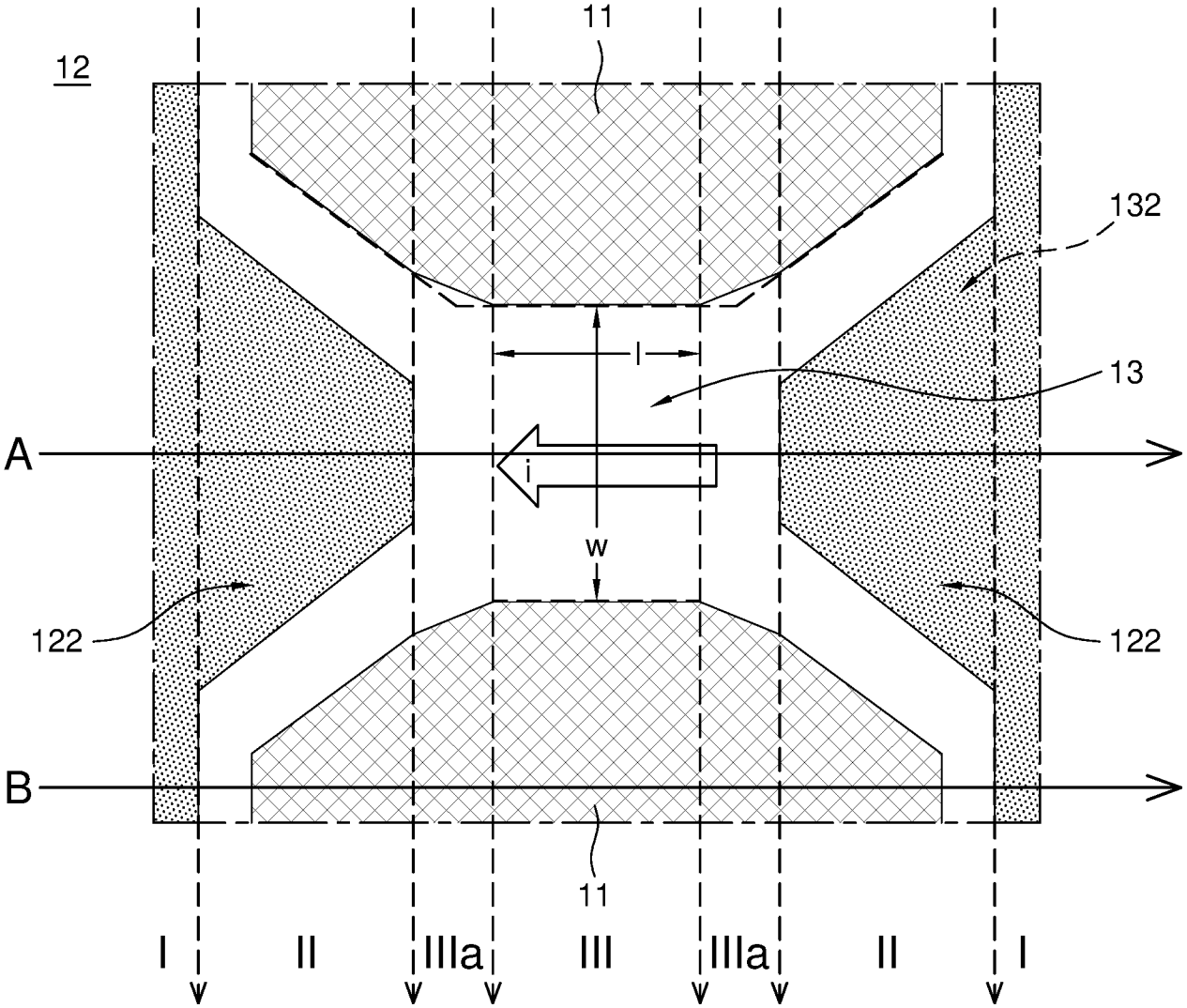
FIG. 2 (A+B) shows a plan view of an embodiment of the invention.

In FIG. 2, a butterfly bridge structure is formed by tapered zones II that extend from contact areas I into a bridging zone III defining a direction of current flow along a shortest connection path i between the contact areas I. The bridging zone III preferably has an elongation transverse to the shortest connection path i. That is, at least a part of the bridging zone III preferably has a width w defined between opposite parallel sides, that is longer than its length 1, defined by the length of the parallel sides. In a further preferred embodiment the bridge zone is connected to the tapered zone II via rounded edges in a intermediate zone Ma between the bridging zone III and tapered zone II, to optimize a current flow and optimize the plasma forming of the bridge structure 13, in particular in bridging zone III.

FIG. 3 shows an exemplary electrical set up of the plasma thruster device 10 in the electrical current peak flow circuit 30, wherein L and R are substantially parasitic in nature, that is, as low as possible, and wherein, after closing switch S, the energy unloads in bridge structure 13. The resistance of the bridge is important for the total functioning of the thruster device because it is part of the dynamic discharge of the capacitor, after the closing of the switch, over the bridge. The electric circuit of the thruster device system comprises of a Capacitor C, a Switch S and a transmission line which all may be provided by microcircuitry. The circuit has a parasitic induction L and a Resistance/impedance R. The current peak flow circuit is coupled to the electrical terminals 122 of the bridge structure 13. The current peak flow circuit comprising circuitry for providing a current peak flow to said electrical terminals for ionizing said bridge structure 13.

De current of such a system can be described as:

$$I(t) = \frac{U_0}{\omega \cdot L}\exp(-t/\tau)\sin(\omega \cdot t) \tag{5.1}$$

With Uo the voltage over the capacitor $\omega=\sqrt{(1/LC)}$ the circular frequency L=the induction of the circuit and $\tau=(2L/R)$ the time constant of the circuit.

An example of such a discharge is found in FIG. 3B for discharge of 2 kV with C=250 nF, R=200 mΩ and L=20 nH.

Figure 4A:
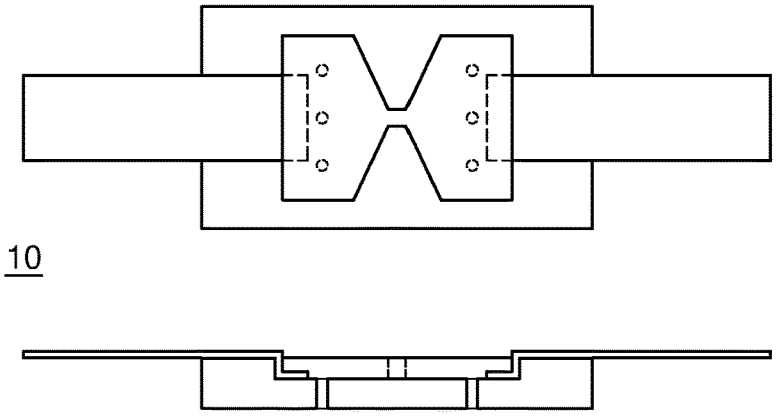
FIG. 4 (A, B, C) shows a schematic process scheme for regeneratively operating the thruster device.

FIG. 4 shows a schematic process scheme for regeneratively operating the thruster device. Starting in FIG. 4*a*, plasma thruster device 10 is shown in top and side view before the electrical discharge. It the device is provided by an electrically insulated (ceramic or other electrically non-conductive materials) substrate, with a shallow, butterfly-shaped reservoir. The reservoir is filled with conductive liquid conductor, forming the conductive 'bridge' in the middle. The conductive liquid may supplied to the reservoir through feed channels, e.g. small capillaries in the bottom. Alternatively, an (electromagnetic) pump device may be used that may simultaneously heat the electrical conductive liquid.

The conductive liquid can be an ionic liquid, molten salt, liquid metal, or any other substance that can be used in liquid form and that has sufficient electrical conductivity. The liquid is either a pure substance, a mixture, or possible a fluid with suspended solid particles. Ideally the liquid has low or negligible vapour pressure, so that it does not evaporate by itself when exposed to the vacuum of space. Furthermore a melting point around room temperature is preferred, as spacecraft are in general maintained around this temperature and having the liquid at this temperature means a low amount of energy is needed to make it liquid and to keep it liquid. Finally a high density of the liquid is desirable for the space application because in small satellites the constraining parameter is usually the volume, not the mass. A high density propellant allows for a high volumetric specific impulse.

A liquid metal is preferred for the intended space application because metals in general have sufficient conductivity and high density. Examples of pure metals that are possible propellants include gallium, indium, tin, cadmium, lead, bismuth, lithium, sodium, potassium, and mercury. Alloys of these and other metals are also interesting. All these examples vary in suitability for the application due to their specific properties such as density, conductivity, reactivity, toxicity, vapour pressure, melting point, molecular mass, specific heat, surface tension, surface wetting properties, chemical compatibility with other materials, and possible other properties. Gallium and its low melting point alloys such as gallium-indium eutectic and gallium-indium-tin ("GalInStan") are suitable. Supplying of conductive liquid towards the bridge after each discharge may be done by a number of ways. These include: 1) 'normal' mechanical pumping systems such as rotating pumps or positive displacement pumps, 2) pressure fed pumping by pressurizing the propellant tank of the system by some gas, 3) electromagnetic pumping, 4) magnetic forces applied via electromagnets or moving permanent magnets (if the liquid has a sufficient magnetic susceptibility, or sufficient ferromagnetic properties (e.g. because of suspended iron particles in the liquid)), or 5) capillary action (either by intrinsic affinity of the liquid to the surfaces of the system, or electrowetting on a dielectric (EWOD).

In an embodiment, bridge material may be liquid Gallium. This material is relatively non-toxic, and has a low melting point (30° C.), high density (5900 kg m−3) and favorable electrical properties. Furthermore, Gallium has a negligible vapor pressure, which prevents it from boiling off when subjected to the vacuum of space.

Figure 4B:
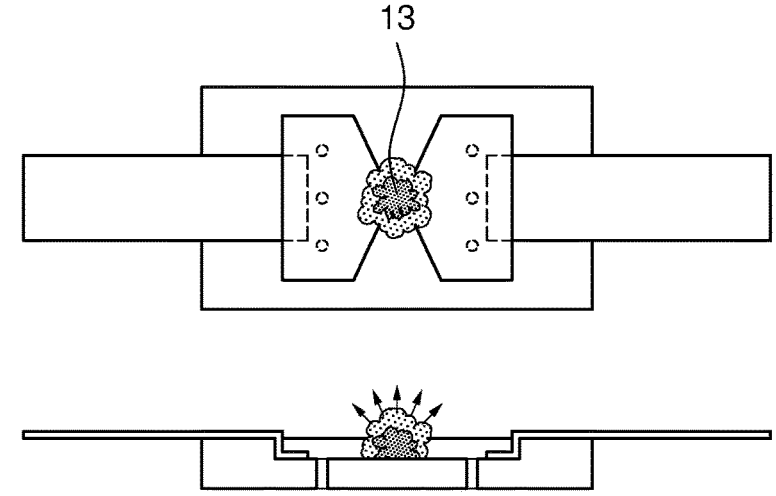

FIG. 4B shows the thruster device 10 during the electrical discharge when a current peak flow is discharged from the current peak flow circuit (not shown). The rapid dissipation of electrical energy results in the explosive ionisation of the bridge 13. The expanding plasma is expelled, thereby generating a small force in the opposite direction (thrust).

Figure 4C:
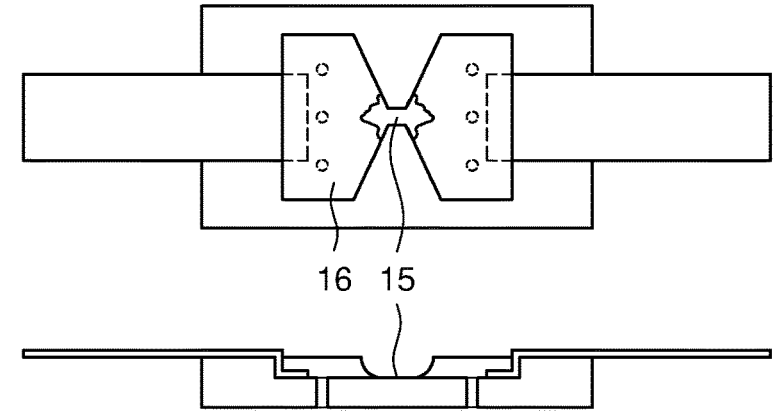

FIG. 4C schematically shows the bridge in regeneration mode after the discharge of FIG. 4B. Initially, there is a gap 15 between the left and right conductive liquid reservoirs, which disrupts the electrical circuit 30 (see FIG. 1). The one or more feed channels are arranged for repeated filling of the basin with electrically conductive liquid prior to providing said current peak flow to regenerate the bridge structure 12. Then, the conductive liquid flows from the reservoirs towards the middle, thereby closing the gap between the reservoirs 16. During this process, the reservoirs are resupplied with from the feed channel with electrically conductive liquid. At the end of the process, the bridge is fully restored and is ready for another discharge to return to FIG. 4A.

Figure 5:
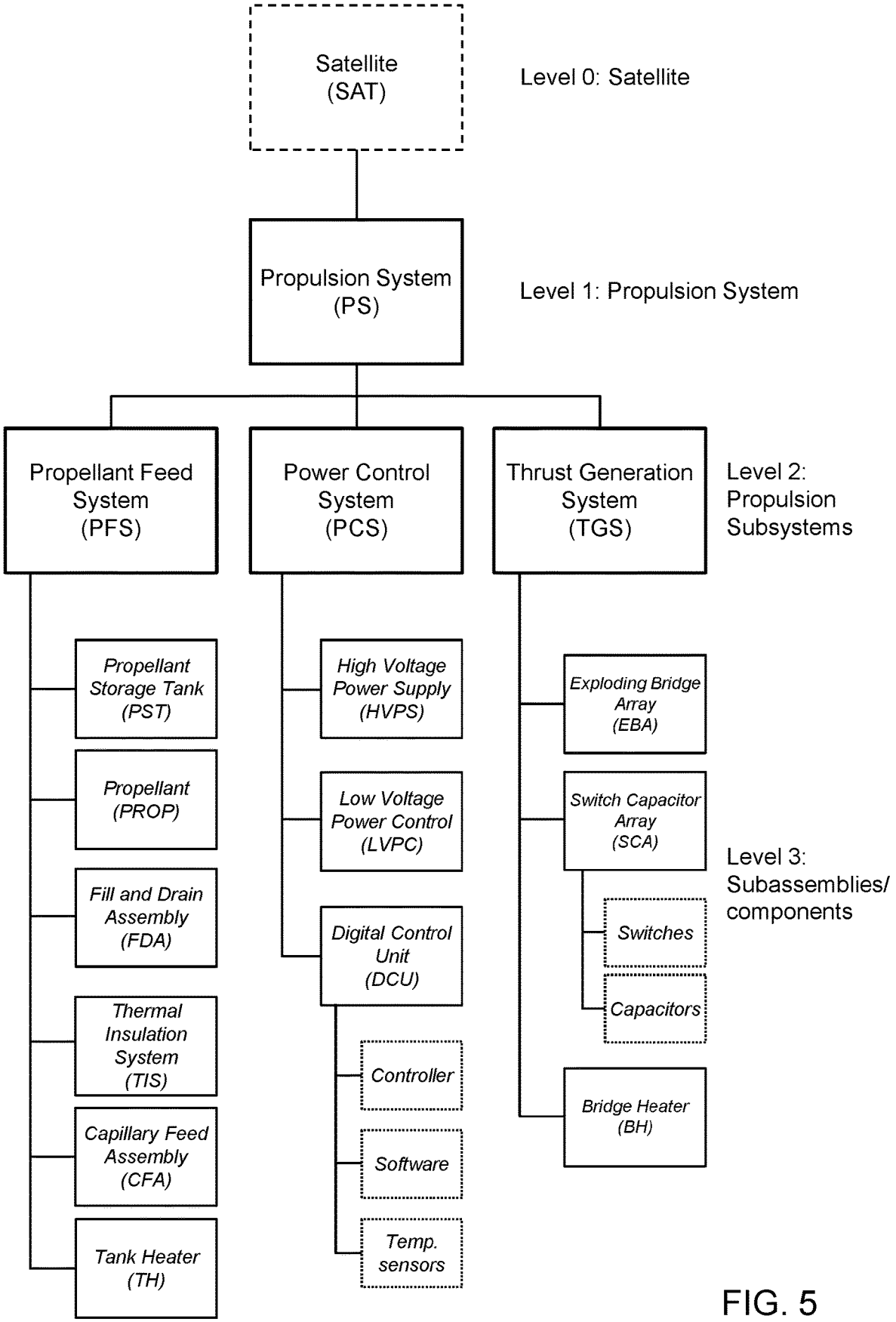
FIG. 5 shows a system breakdown diagram of a complete propulsion system, of which the electrically conductive liquid propellant pulsed plasma thruster is a subsystem.

FIG. 5 shows a schematic system diagram of a possible architecture of a plasma propulsion device according to the principles elaborated hereabove. The propulsion system may comprise further subsystems as follows:

Thrust Generation System (TGS)

This subsystem comprises the plasma thruster device disclosed hereabove arranged to generate a small thrust, using the principle of the regenerating bridge structure. The device may comprise one or more regenerating bridge structures (e.g. in an array), and an electrical circuit containing the switch(es) and capacitor(s) (Switch Capacitor Array, or SCA). Furthermore, a heater may be needed to keep the liquid metal propellant in the liquid phase.

Propellant Feed System (PFS)

This subsystem stores the conductive liquid propellant, e.g. as shown in FIG. 1 to keep it above its melting temperature (30° C. for Gallium, 10° C. for Galinstan) and supply to the TGS. The PFS may comprise a Propellant Storage Tank (PST), conductive liquid propellant (PROP), a propellant Fill and Drain Assembly (FDA), a Thermal Insulation System (TIS), a Capillary Feed Assembly (CFA) and optionally a Tank Heater (TH).

Power Control System (PCS)

This subsystem contains power electronics for distribution of electrical power over the different subsystems and subassemblies and for generating a high voltage for charging the capacitor in the current peak flow circuit. The PCS may comprise of a High Voltage Power Supply (HVPS), a Low Voltage Power Control System (LVPC) and a Digital Control Unit (DCU).

The electrically conductive liquid propellant pulsed plasma thruster as disclosed herein uses a conductive liquid propellant (such as liquid Gallium), instead of an insulating solid propellant.

Since the propellant is already conductive, the electrically conductive liquid propellant pulsed plasma thruster device does not require an igniter. Therefore, the electrically conductive liquid propellant pulsed plasma thruster device generates a single discharge per pulse (instead of an 'ignition' discharge and a 'main' discharge).

The electrically conductive liquid propellant pulsed plasma thruster device uses a switch to close the electrical circuit and trigger the discharge.

The discharge in a electrically conductive liquid propellant pulsed plasma thruster device can be an order of magnitude shorter than conventional pulsed plasma thruster devices (i.e. ~0.5 μs instead of ~10 μs), resulting in higher discharge currents which will result in better energy coupling with the propellant.

An electrically conductive liquid propellant pulsed plasma thruster device does not have physical electrodes between which the discharge is generated. The propellant basin acts as the electrodes and regenerates after the discharge. Hence, an electrically conductive liquid propellant pulsed plasma thruster device is not susceptible to electrode erosion.

The gravimetric specific impulse is directly related to the exhaust velocity of the propulsion system:

$$Isp_grav = Ueff/g0 \quad [1]$$

In this equation, Isp_gray is the gravimetric specific impulse [s], Ueff is the effective exhaust velocity [m s−1] and g0 is the gravitational acceleration at sea level [m s−2]. This equation shows that in order to obtain a high gravimetric specific impulse (high mass efficiency), the propulsion system should be able to accelerate its propellant to a high velocity. For electric or thermo-electric plasma propulsion system, the relationship between electric power consumption, specific impulse and thrust level is given by the following equation:

$$P = Isp \cdot F \cdot g0/2 \cdot \eta t \quad [2]$$

In this equation, P is the power consumption [W], Isp is the gravimetric specific impulse [s], g0 is the gravitational acceleration at sea level [m s−2] and ηt is the thruster efficiency [-], which is the ratio between the kinetic jet power of the exhaust plume and the electrical input power to the propulsion system. The thruster efficiency is the product of several sub-efficiencies that take into account the losses of the different energy conversion steps in the propulsion system. Based on the experimental data, a value of at least ηt=0.25 can be assumed, which is a conservative estimate for the thruster efficiency. For nano-satellites, it is important that the propulsion system occupies as little volume as possible, so a nanosatellite propulsion system may be optimized for maximum volumetric specific impulse, which is simply the product of the gravimetric specific impulse and the propellant density:

$$I_{vol}=I_{sp}\cdot\rho_p \quad [3]$$

Figure 6:
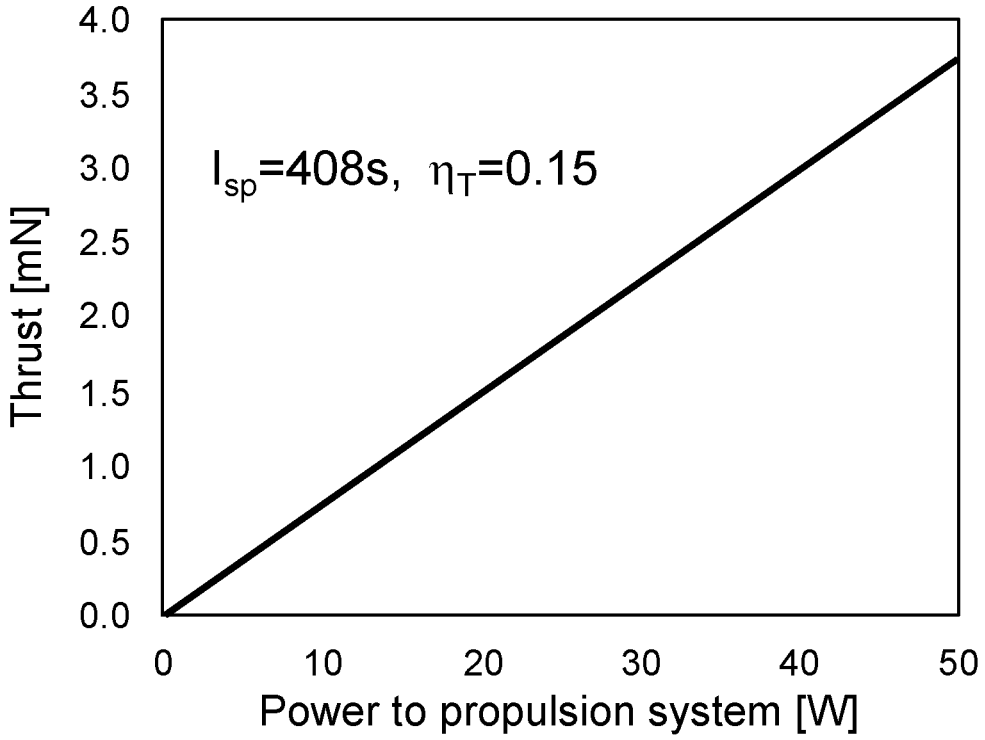
FIG. 6 shows a diagram relating thrust in related to electric power of the propulsion system.

In this equation, $I_{vol}$ is the volumetric specific impulse [kg s $m^{-3}$] and $\rho_p$ is the density of the propellant [kg $m^{-3}$]. Hence, in order to obtain a high volumetric specific impulse, the propulsion system preferably operates at a high gravimetric specific impulse and/or use a propellant with a high density. The disclosed plasma thruster uses electrically conductive liquid, for example a liquid metal such as Gallium or Galinstan as propellant, which has a density that is 2.7 times higher than that of a solid propellant used in conventional plasma thruster using solid PTFE as propellant (i.e. 5900 kg $m^{-3}$ compared to 2200 kg $m^{-3}$). The gravimetric specific impulse of the propulsion system can be calculated with equation 1 and could be equal to 408 s for a plasma velocity of 4000 m/s. This is a conservative estimate, and may be much higher. The volumetric specific impulse of the propulsion system can be calculated with equation 2 and is the product of the gravimetric specific impulse and the propellant density. With a gravimetric specific impulse of 408 s and a propellant density of 5907 kg m−3 (density of Gallium at 1 atm. and 298.15K), the volumetric specific impulse may be about 2.4×10^6 kg s m−3 or higher. This means that the electrically conductive liquid propellant pulsed plasma thruster could operate at a 2.7 times lower gravimetric specific impulse than a conventional plasma thruster, while having the same volumetric specific impulse and a significantly increased thrust to power ratio. As the thrust to power ratio is inversely proportional to the gravimetric specific impulse, this would result in a 2.7 times higher thrust to power ratio. The electrically conductive liquid propellant pulsed plasma thruster concept has the potential of reaching a substantially higher thrust to power ratio at the same volumetric specific impulse, or a substantially higher volumetric specific impulse at the same thrust to power ratio, than a conventional plasma thruster. FIG. 6 shows a diagram relating thrust in mN related to electric power of the propulsion system. The amount of electrical power available for the propulsion system is highly dependent of the size of the satellite (i.e. the area of its solar panels). For nanosatellites, the electrical power available for propulsion may be between 10 W and 15 W. Assuming a power budget of 10 W, the propulsion system could produce a thrust of approximately 0.75 mN. The total ΔV that can be delivered by a propulsion system depends on the amount of propellant on board and on the specific impulse of the propulsion system. This relationship is given by the Tsiolkovsky rocket equation:

$$\Delta V=\mathrm{Isp}\cdot g0\cdot\ln[m0/(m0-mp)] \quad [4]$$

In this equation, m0 is the initial satellite mass including propellant [kg] and mp is the propellant mass [kg]. The total propellant mass (mp) depends on the volume that is allocated to the propulsion system and on the volumetric loading fraction of the propulsion system (i.e. the fraction of the propulsion system volume that is occupied by the propellant). Consider a hypothetical nano-satellite with the following mass and volume distribution:

Satellite mass without propellant: 5 kg—Total satellite volume (incl. propulsion system (PS)): 6 L—Volume allocated to PS: 1 L If the propulsion system has a propellant loading fraction of 75%, the total propellant mass would be 4.4 kg and the initial satellite mass (including propellant) would be 9.4 kg. Substituting these values into equation 4, results in a total ΔV of 2300 m s−1.

FURTHER EMBODIMENTS

Figure 7:
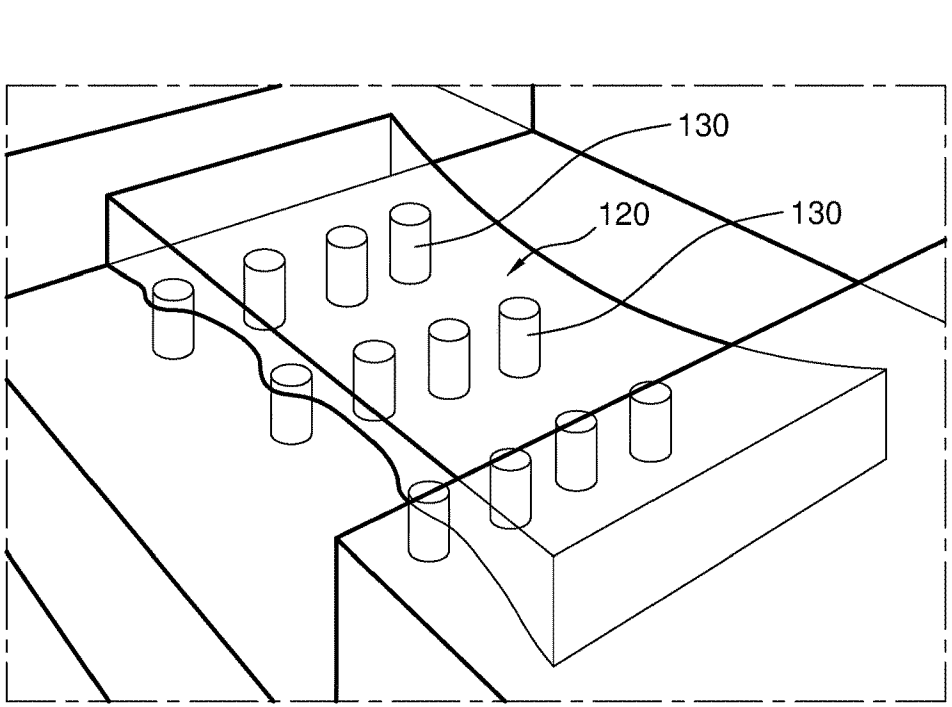
FIG. 7 (A+B) shows an embodiment of an electrical conducting bridge.
Figure 7:
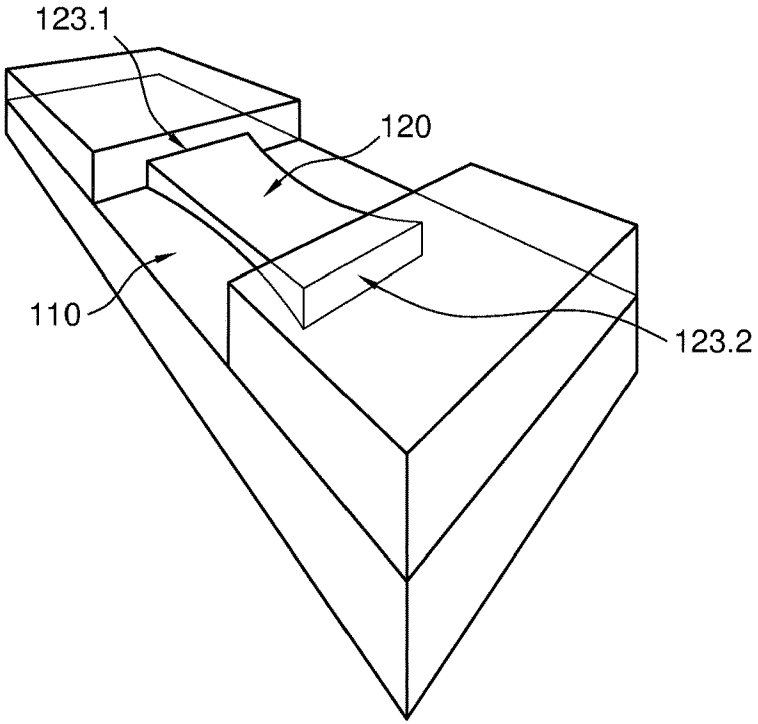

FIG. 7*a* shows an embodiment of an electrically insulating substrate 110, said substrate comprising one or more feed channels 123.1 and 123.2 for feeding an electrically conductive liquid to a bridge structure 120 configured to form, when provided with the electrically conductive liquid, an electrical conducting bridge. In the example, the feed channels are formed by opposite orifices that connect to a feed container (not shown). In FIG. 7*b*, additionally, it shown that additional feed channels, in the form small orifices 130 in the bridge substrate 110 through which liquid is fed can be provided, which may have an advantage to pin the bridge geometry into place. The orifices may have a capillary action or may be fed by an active feeding mechanism such as an electromechanic pump (not shown).

Figure 8:
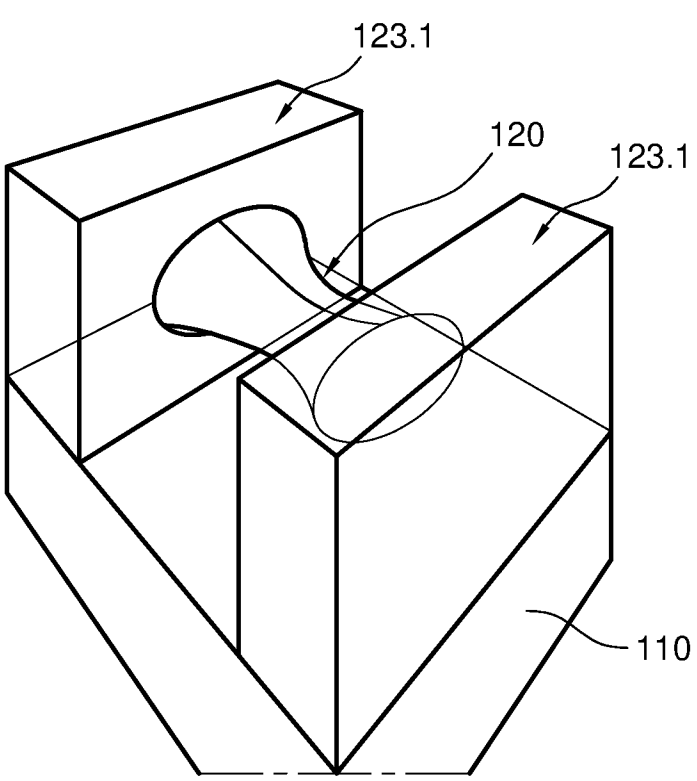
FIG. 8 (A+B) shows alternative structures of an electrical conducting bridge.
Figure 8:
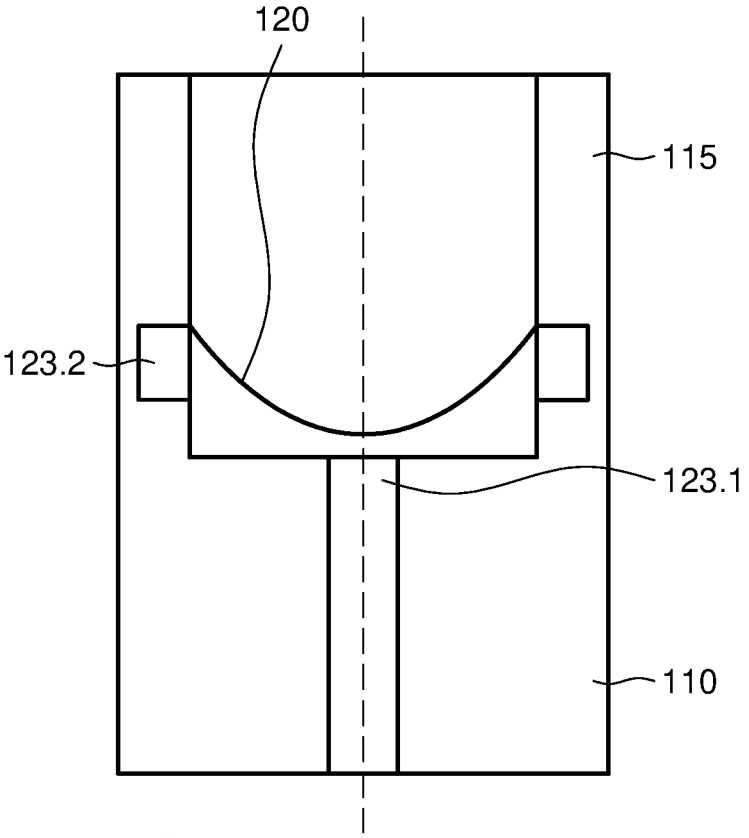

FIGS. 8*a* and 8*b* show alternative structures of an electrically insulating substrate 110, comprising one or more feed channels 123.1 and 123.2 for feeding an electrically conductive liquid to a bridge structure 120 configured to form, when provided with the electrically conductive liquid, an electrical conducting bridge.

In FIG. 8*a*, the bridge 120 is a shallow meniscus, formed between an annular orifice 123.1 and a central orifice, which may be both fed by a feeding mechanism of the type previously described. The substrate 110 of FIG. 8*a* may have extensions 115, extending from substrate 110, e.g. tubular in form, to direct a plasma, generated by the bridge structure 120 away in axial direction of the central orifice 123.1.

FIG. 8*b* shows another bridge structure, where a liquid bridge is formed by cohesive force of oppositely arranged orifices 123.1, 123.2 that are fed by a liquid feeding mechanism. The bridge 120 may even be freestanding, i.e. the bridge 120 does not need to be in contact with the substrate 110.

1. The working principle of the present invention allows for high density propellants, which leads to a high volumetric ISP. While a conventional pulsed plasma thruster may have a comparable gravimetric ISP the present device can improve the volumetric ISP by allowing a high density propellant, the volumetric ISP being the product of the gravimetric ISP and the propellant density. This provides an advantage that the device can be formed with little volume, as in a nano-satellite, wherein volume is a limiting factor.
2. The single stage—direct plasmafication, without an ionizing pre-stage and secondary acceleration step as in conventional thrusters provides thruster pulses at time scales considerably shorter than conventional pulsed plasma thrusters. Accordingly, a higher thrust-to-power ratio can be achieved, due to the higher thruster efficiency on these shorter time scales. Thus, an advantage is a more efficient energy conversion, although absence of a secondary acceleration stage limits the gravimetric ISP. Accordingly, the thruster of the present invention has a more favourable energy efficiency for providing a specific thruster force, while using a higher mass propellant.
3. The liquid bridge formed by the bridge structure will at the same time limit degradation of the electrodes, which are formed by the liquid metal that can regenerate by continuous feeding electrically conductive liquid to a bridge structure While example embodiments were shown for systems and methods, also alternative ways may be envisaged by those skilled in the art having the benefit of the present disclosure for achieving a similar function and result. E.g. some components may be combined or split up into one or more alternative components.

For example, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the scope of the present systems and methods as set forth in the claims that follow. The specification and drawings are accordingly to be regarded in an illustrative manner and are not intended to limit the scope of the appended claims.

In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. The mere fact that certain measures are recited in mutually different claims does not indicate that a combination of these measures cannot be used to advantage.

The invention claimed is:

1. A plasma thruster device comprising:

electrical terminals; and an electrically insulating substrate, wherein a bridge structure is formed on the electrically insulating substrate, wherein the electrically insulating substrate comprises one or more feed channels for feeding an electrically conductive liquid to the bridge structure, wherein the bridge structure is configured to form, when provided with the electrically conductive liquid, an electrical conducting bridge, wherein the bridge structure is configured to have the electrical conducting bridge form, at contact areas, electrical contact with the electrical terminals, and wherein the bridge structure is arranged for forming a plasma from the electrically conductive liquid, when the electrically conductive liquid is ionized by a current peak flow provided by a current peak flow circuit that contacts the contact areas via the electrical terminals.

2. The plasma thruster device according to claim 1, wherein the bridge structure and the contact areas extend along the electrically insulating substrate, so that a plasma jet is formed substantially in a direction away from the electrically insulating substrate.

3. The plasma thruster device according to claim 1, further comprising the current peak flow circuit that is coupled to the electrical terminals, and wherein the current peak flow circuit comprises circuitry configured to provide the current peak flow to the electrical terminals that ionizes the bridge structure.

4. The plasma thruster device according to claim 3, wherein the current peak flow circuit is a single stage circuit.

5. The plasma thruster device according to claim 1, wherein the one or more feed channels are arranged for repeated filling of a basin containing the bridge structure, which is formed in the substrate, with the electrically conductive liquid prior to providing the current peak flow to regenerate the electrical conducting bridge formed in the bridge structure.

6. The plasma thruster device according to claim 1, wherein the one or more feed channels are provided by capillaries, and wherein the electrically conductive liquid is fed through the one or more feed channels by capillary action.

7. The plasma thruster device according to claim 1, wherein the electrically conductive liquid is fed through the one or more feed channels by an electromagnetic pump.

8. The plasma thruster device according to claim 1, wherein the electrically conductive liquid is a liquid metal having a liquid state at least within a temperature range of −50 to +100° C.

9. The plasma thruster device according to claim 8, wherein the liquid metal comprises any of the group consisting of: Gallium, Mercury, Cesium, Rubidium, and Galinstan.

10. The plasma thruster device according to claim 1, further comprising a feed container arranged for containing the electrically conductive liquid, wherein the feed container is coupled to the one or more feed channels, and wherein the feed container comprises a liquid fill and drain mechanism for transferring the electrically conductive liquid to and from the feed container.

11. The plasma thruster device according to claim 1, further comprising a heater configured to heat a basin containing the bridge structure, which is formed in the substrate, and the one or more feed channels for liquefying the electrically conductive liquid.

12. The plasma thruster device according to claim 1, wherein a basin containing the bridge structure, which is formed in the substrate, provides for a conductive liquid layer thickness smaller than 100 micron.

13. The plasma thruster device according to claim 1, wherein the bridge structure is formed by tapered recessions that extend from the contact areas into a bridging zone defining a direction of current flow along a shortest connection path between the contact areas; wherein the bridging zone has an elongation transverse to the shortest connection path.

14. The plasma thruster device according to claim 13, wherein the bridging zone is connected to the tapered recessions via rounded edges.

15. The plasma thruster device according to claim 1, wherein the electrical terminals are provided with metal interconnection pads.

* * * * *